US006890066B2

(12) United States Patent
Parish et al.

(10) Patent No.: US 6,890,066 B2
(45) Date of Patent: May 10, 2005

(54) INKJET PRINTER HAVING IMPROVED EJECTOR CHIP

(75) Inventors: George Keith Parish, Winchester, KY (US); Kristi Maggard Rowe, Richmond, KY (US); John Glenn Edelen, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 52 days.

(21) Appl. No.: 10/443,477

(22) Filed: May 22, 2003

(65) Prior Publication Data

US 2004/0233255 A1 Nov. 25, 2004

(51) Int. Cl.[7] ..... B41J 2/05
(52) U.S. Cl. ..... 347/63
(58) Field of Search ..... 347/63, 68, 70, 347/71, 72, 55, 54, 20, 44, 9, 5, 1, 56–62; 216/27, 2; 257/139, 147, 170, 173, 487, 488, 490, 206, 369, 372, 373; 438/41, 39, 21

(56) References Cited

U.S. PATENT DOCUMENTS

| | | | | |
|---|---|---|---|---|
| 4,678,936 | A | | 7/1987 | Holloway |
| 4,891,533 | A | | 1/1990 | Holloway |
| 5,103,281 | A | | 4/1992 | Holloway |
| 5,411,900 | A | | 5/1995 | Nagel |
| 5,500,548 | A | | 3/1996 | Smayling |
| 5,525,825 | A | | 6/1996 | Nagel |
| 5,719,733 | A | | 2/1998 | Wei et al. |
| 5,723,882 | A | * | 3/1998 | Okabe et al. |
| 5,760,459 | A | | 6/1998 | Tam et al. |
| 5,828,110 | A | | 10/1998 | Wollesen |
| 5,895,247 | A | | 4/1999 | Tam et al. |
| 5,963,779 | A | | 10/1999 | Leigh et al. |
| 6,107,146 | A | | 8/2000 | Gardner et al. |
| 6,267,905 | B1 | * | 7/2001 | Silverbrook |
| 6,359,316 | B1 | * | 3/2002 | Voss et al. |
| 6,426,248 | B2 | | 7/2002 | Francis et al. |

FOREIGN PATENT DOCUMENTS

| | | |
|---|---|---|
| JP | 3295655 | 12/1991 |
| JP | 8238773 | 9/1996 |

* cited by examiner

*Primary Examiner*—Raquel Yvette Gordon
(74) *Attorney, Agent, or Firm*—Lexmark International, Inc.

(57) ABSTRACT

An inkjet printer includes a printhead for ejecting ink onto a print medium. The printhead includes electrical and mechanical structure for controlling the ejection of the ink. The printhead includes an ink ejector chip having at least one active device, such as a transistor and the like. A guard ring substantially surrounds select active devices included on the chip. The guard ring tends to prevent latch-up when the chip operates to energize the ink. The chip is manufactured using a substrate devoid of an overlying epitaxial layer which tends to reduce the cost of manufacturing the chip.

20 Claims, 7 Drawing Sheets

INKJET PRINTER HAVING IMPROVED EJECTOR CHIP

FIELD OF THE INVENTION

The present invention is generally directed to inkjet printers. More particularly, the invention is directed to an improved inkjet ejector chip for use in an inkjet printer.

BACKGROUND OF THE INVENTION

Inkjet printers utilize a printhead which contains various electrical and mechanical components for causing ink to be injected onto a print medium to form an image. The printhead includes a semiconductor chip containing ejection devices and a nozzle plate for ejecting ink from the printhead. The chips also contain integrated circuits that are coupled to the ejection devices on the chips. Proper operation of the ejection devices and circuits is impacted by the construction of the chips. Generally, the choice of a starting substrate material plays a key role in determining the final cost and operational properties of an integrated circuit.

Many of the complimentary metal oxide semiconductor (CMOS) integrated circuits fabricated today for ink jet ejector chips use a relatively high-resistance epitaxial layer 4 overlaying a low-resistivity sub-wafer layer 2 (see FIG. 1). A barrier layer 6 and a metallization layer 8 typically overlay the epitaxial layer 4. This fabrication technique results in reduced parasitic resistances between NMOS and PMOS devices, thereby substantially reducing the likelihood of device latch-up. However, fabricating integrated circuits using a relatively high-resistance epitaxial layer 4 overlaying a low-resistivity sub-wafer layer 2 requires additional material and fabrication steps, resulting in a more costly integrated circuit.

An improved inkjet ejector chip having desirable electrical properties and operating characteristics is needed to reduce the manufacturing costs of ink jet printheads.

The foregoing and other needs are met by an inkjet printer including a printhead for printing an image onto a print medium. The printhead includes an ink ejector chip which operates to heat and energize ink contained in the printhead. The chip includes at least one active device, such as a transistor, logic device, etc. operating to control the electrical operation of the chip.

According to one aspect of the invention, an inkjet printer includes a printhead for printing an image onto a print medium. An improved ink ejector chip includes a plurality of ejection devices for causing ink to be expelled from nozzles on the printhead toward a print medium. Circuitry on the chip controls the activation of one or more of the ejection devices. The chip includes at least one active device having power and ground connections. The active device includes a substrate and is devoid of an overlaying epitaxial layer. At least one dielectric layer is disposed on the substrate, and at least one metallic layer is disposed adjacent to the at least one dielectric layer and the substrate. The chip includes a guard ring disposed on the substrate, substantially surrounding the active device. The guard ring tends to prevent latch-up of the active device during operation of the chip. The chip also includes a power lead electrically connected to the active device for providing power to the device and a ground lead electrically connected to the active device.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 2:
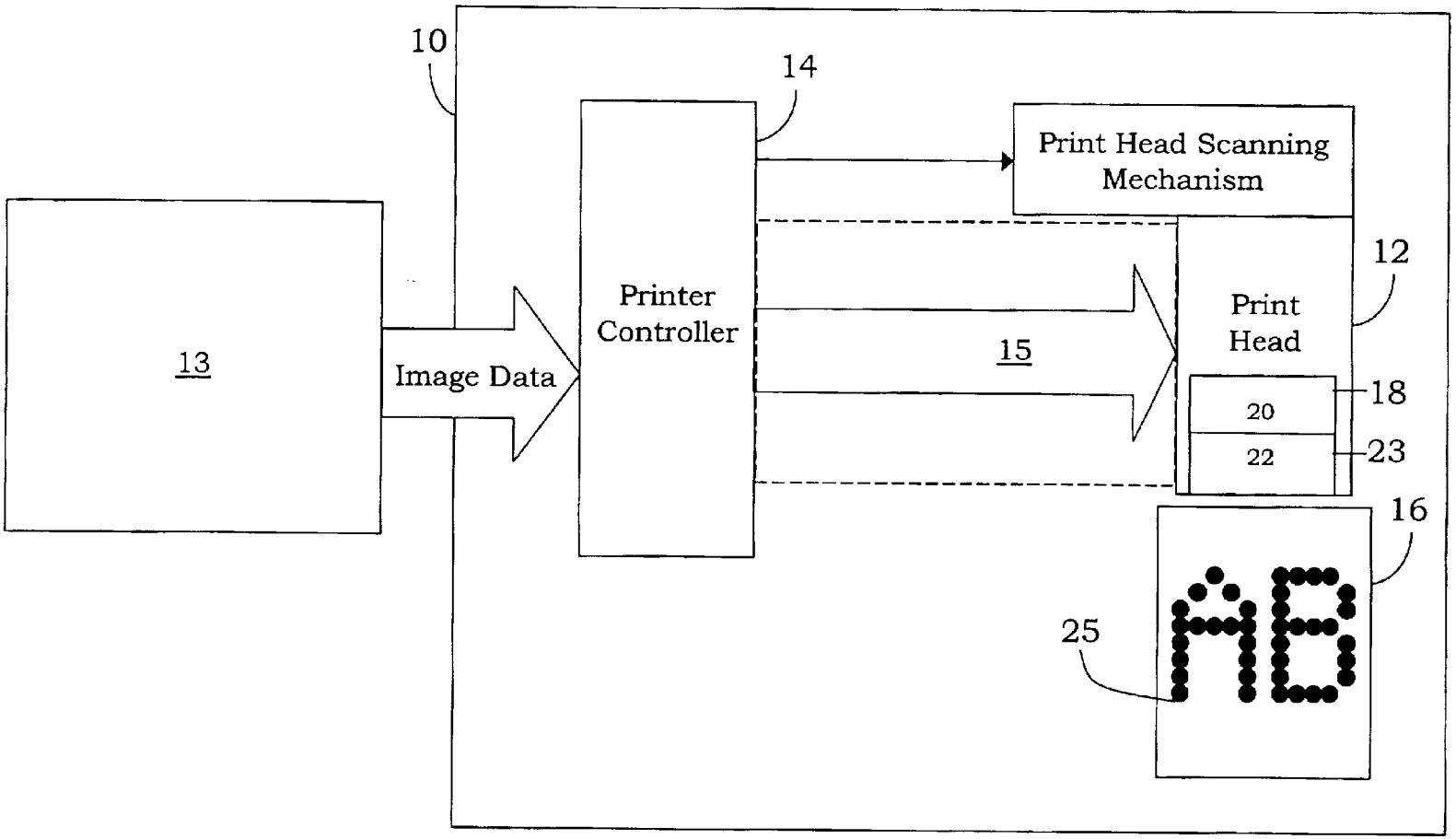
FIG. 2 is a functional block diagram of a printing device.
Figure 3:
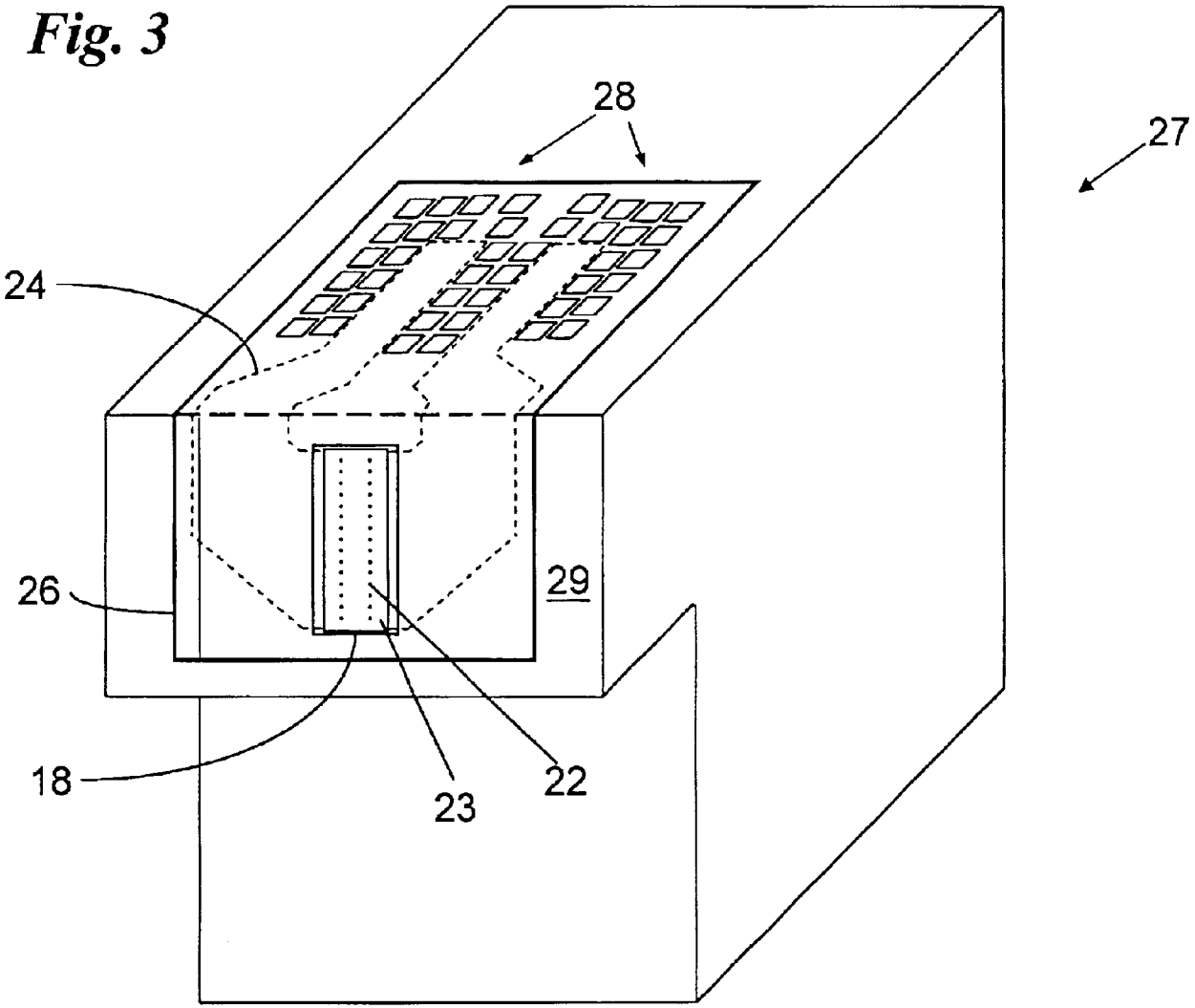
FIG. 3 is a perspective view, not to scale, of an ink cartridge and printhead for an inkjet printer.

Referring now to FIGS. 2 and 3, an inkjet printer 10 including a printhead 12 and other printing components is shown. A host computer 13 transmits image data to the printer 10 for printing an image. Based on the image data and other parameters received from the host computer 13, the printer controller 14 transmits various control signals 15 which control the printhead 12 to print the image onto a print medium 16.

The printhead 12 includes an ink ejector chip 18 having electrical structure for ejecting ink on command toward the print medium 16. A number of ejection devices 20, when activated, cause ink to be expelled through one or more nozzles 22 formed in a nozzle plate 23 toward the print medium 16. The nozzles 22 and ejection devices are arranged in a pattern, and selectively controlled to print a desired image 25 onto the print medium 16. Ejection devices 20 may be selected from heater resistors (resistive heating elements), piezoelectric devices, and the like.

Figure 1:
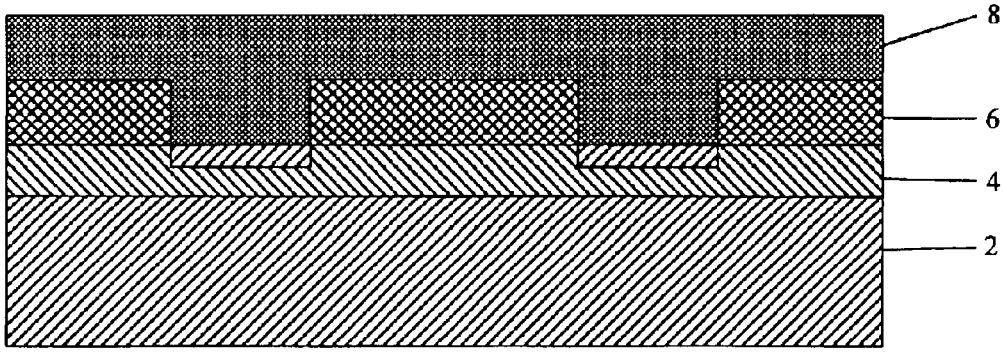
Fig. 1 Prior Art
FIG. 1 is a partial cross-sectional view of a prior art ink ejector chip.
Figure 6A:
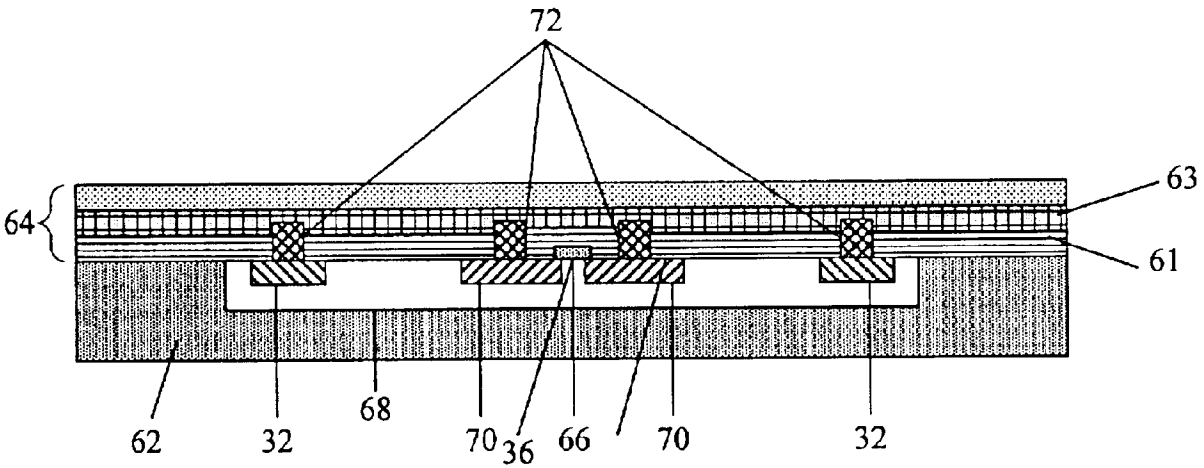
FIGS. 6*a* and 6*b* depict partial cross-sectional views, not to scale, of the guard rings and devices of FIG. 5; and, FIG. 7 is a schematic drawing of a portion of an ink ejector chip in accordance with one embodiment of the invention.
Figure 6B:
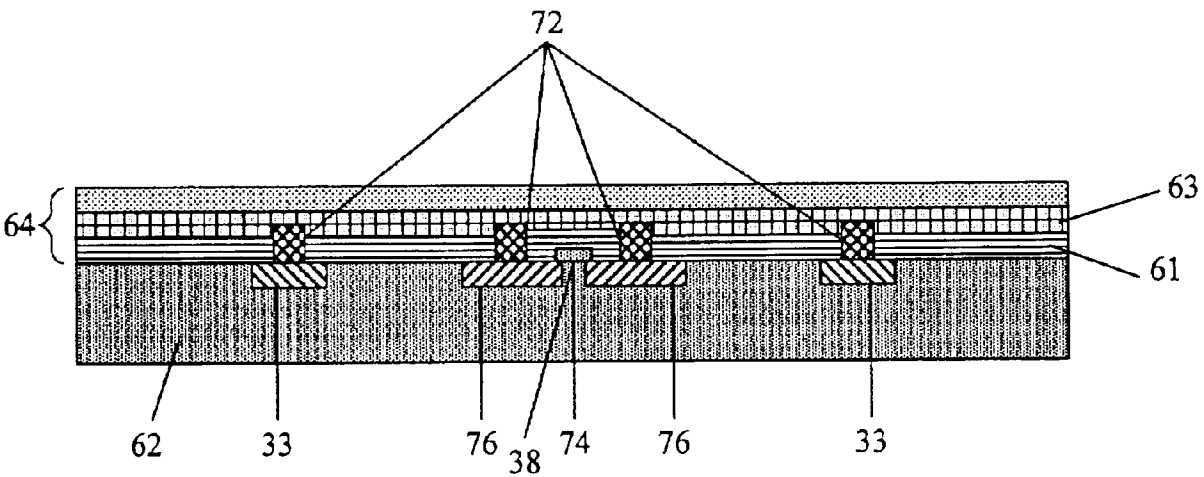

According to the most preferred embodiment, the ejector chip 18 is fabricated using a substrate 62 devoid of an overlying epitaxial layer during its manufacture (FIGS. 6*a* and 6*b*). As described above, use of a low-resistivity sub-wafer or substrate 2 (FIG. 1) and an overlying higher resistivity epitaxial layer 4 adds cost and complexity when manufacturing ink jet printheads containing such ink ejector chips. By manufacturing the ink ejector chip 18 without the overlaying epitaxial layer on the substrate 62, the chip 18 can be manufactured more efficiently and with less cost. However, simply eliminating the epitaxial layer 4 (FIG. 1) may result in operational problems such as latch-up during ink ejector activation.

An ink cartridge 27 for printer 10 is shown in FIG. 3. The ink cartridge 27 has a printhead portion 29 and a tape automated bonding (TAB) circuit 26 attached to the printhead portion 29 of the cartridge 27. The TAB circuit 26 contains a number of electrical traces 24 for providing electrical pathways to the ink ejector chip 18. Electrical contacts 28 on the TAB circuit 26 provide an electrical connection between the ink cartridge 27 and the printer 10. During operation, the printhead 12 receives control signals 15 from the printer controller 14 when the printhead 12 is electrically connected to the printer 10.

Figure 4:
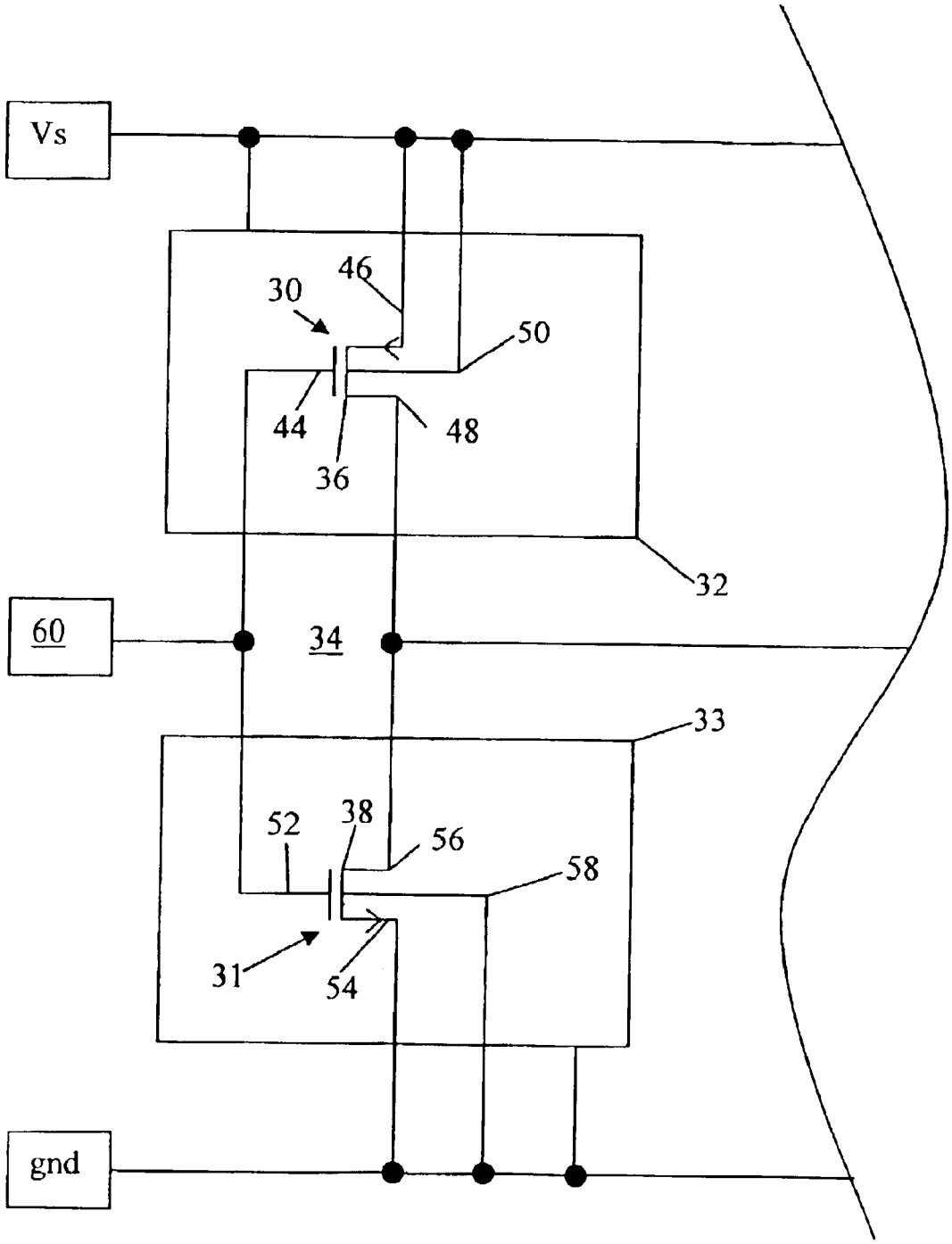
FIG. 4 is a schematic drawing of an active device disposed on an ink ejector chip in accordance with one embodiment of the invention.

According to a preferred embodiment, the ink ejector chip 18 includes a number of active devices 30 and 31 (FIG. 4).

The active devices 30 and 31 include, but are not limited to, field-effect transistors (FETs), diodes, silicon controlled rectifier (SCR) devices, logic cells, etc. According the preferred embodiment of the ink ejector chip 18, a select number of active devices 30 and 31 include guard rings 32 and 33. Most preferably, one or more guard rings 32, 33 surround all active devices, including input/output (I/O) devices and internal devices. It is preferred that the guard rings 32 or 33 substantially surround a corresponding active device 30 or 31. Since the ink ejector chip 18 does not include an epitaxial layer disposed on the substrate, the guard rings 32 and 33 tend to exhibit collector-like properties and prevent device latch-up during operation of the ejector device chip 18.

During printer operation, the active devices 30, 31 control various features/functions of the ink ejector chip 18, including the activation of the ink ejection device 20. Examples of active devices 30, 31 on the ejector chip 18 are shown in the schematic diagram of FIG. 4. It will be understood that specific examples and embodiments described herein are not intended to limit the invention and the scope of the invention is provided with reference to the claims below.

The example of FIG. 4 corresponds to a complimentary metal-oxide semiconductor (CMOS) device 34. As described above, it is preferred to have guard rings 32 and 33 substantially surrounding select active devices 30 and 31 on the ejector chip 18. As shown, the CMOS device 34 includes a p-type channel metal-oxide semiconductor (PMOS) transistor 36 and an n-type channel metal-oxide semiconductor (NMOS) transistor 38. Guard rings 32 and 33 substantially surround the PMOS transistor 36 and the NMOS transistor 38. Most preferably, during the manufacture of the ink ejector chip 18, as described below, guard ring 32 is an n-type guard ring formed to substantially surround and contain the PMOS transistor 36. Similarly, guard ring 33 is a p-type guard ring formed to substantially surround and contain the NMOS transistor 38. Guard rings 32 and 33 tend to prevent device latch-up during operation of the ejector chip 18.

Continuing with the example, the PMOS transistor 36 includes gate 44, source 46, drain 48, and body 50 connections. The NMOS transistor 38 also includes gate 52, source 54, drain 56, and body 58 connections. According to a most preferred embodiment, the body connections 50 and 58 are located a distance of about 2.4 micrometers from the gates 44 and 52 during manufacture of the PMOS and NMOS transistors 36 and 38. As shown in FIG. 4, the gate 44 of the PMOS transistor 36 is electrically connected to the gate 52 of the NMOS transistor 38. Each gate 44 and 52 of the PMOS and NMOS transistors 36 and 38 is also electrically connected to a common control input 60.

With continuing reference to FIG. 4, the PMOS transistor source 46 is electrically connected to a power source (Vs). The PMOS transistor body 50 is also electrically connected to the power source (Vs). The NMOS transistor source 54 is electrically connected to a ground (gnd). The NMOS transistor body 58 is also electrically connected to ground (gnd). The PMOS transistor drain 48 is electrically connected to the NMOS transistor drain 56. As described above, an n-type guard ring 32 most preferably substantially surrounds the PMOS transistor 36 and a p-type guard ring 33 substantially surrounds the NMOS transistor 38. As shown in drawing of FIG. 4, it is most preferred that the n-type guard ring 32 be electrically connected to the power source (Vs). The p-type guard ring 33 is most preferably electrically tied to ground (gnd). As described above, when power is applied to the ink ejector chip 18, the guard rings 32 and 33 tend to prevent device latch-up.

Figure 5:
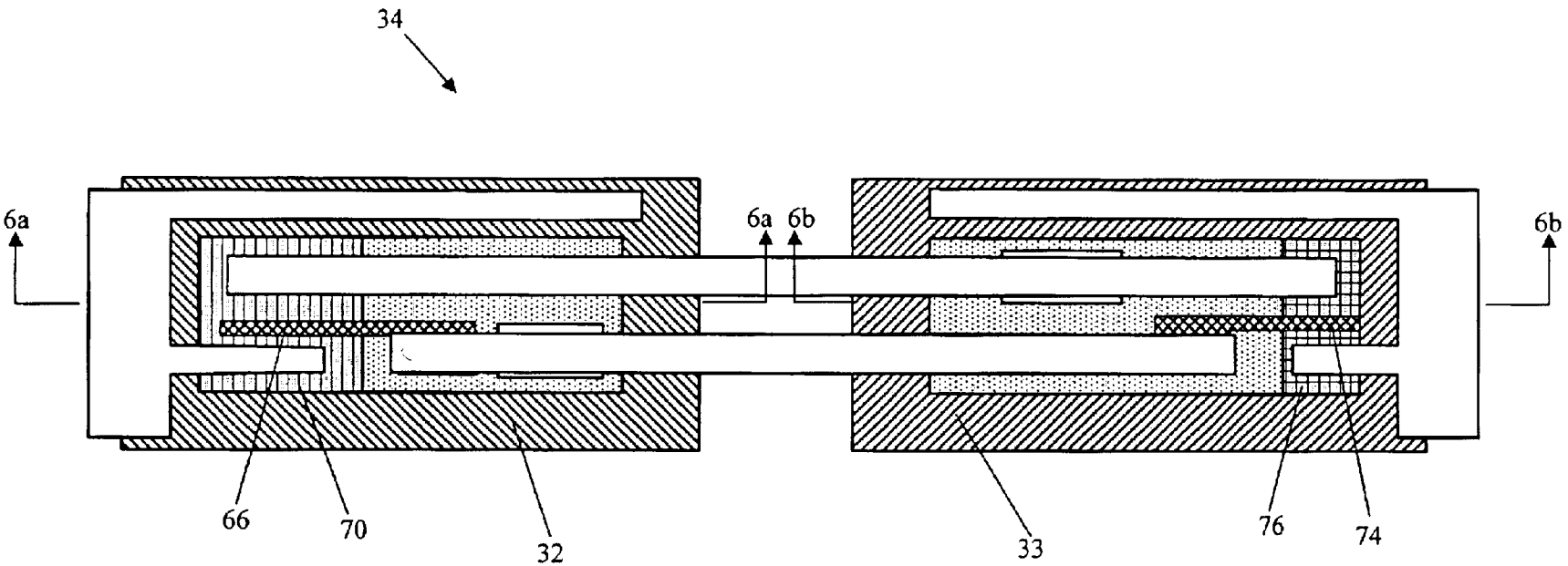
FIG. 5 is a cross-sectional plan view, not to scale, of guard rings and active devices disposed on a substrate.

Referring now to FIG. 5, a plan view, not to scale, of a CMOS device 34 is shown. The device 34 includes a PMOS transistor 36 which includes p-type implants 70 and a polysilicon gate 66. The CMOS device 34 also includes an NMOS transistor 38 which includes n-type implants 76 and a polysilicon gate 74. An n-type guard ring 32 substantially surrounds the PMOS transistor 36. Likewise, a p-type guard ring 33 substantially surrounds the NMOS transistor 38.

Referring now to FIGS. 6*a* and 6*b*, cross-sectional views, not to scale, of the PMOS transistor 36 and an NMOS transistor 38 are depicted. The examples depicted in FIGS. 5, 6*a*, and 6*b* are somewhat simplified for ease of discussing the active devices and ejector chip structure and are not intended to limit the invention. Various semiconductor manufacturing techniques can be used to form the active devices 30 and 31 on the ink ejector chip 18, such as, deposition, photolithography, etch, etc. and other known semiconductor manufacturing techniques.

As shown in FIG. 6*a*, the PMOS transistor includes a substrate 62. Most preferably, the substrate 62 has a resistivity of between about 0.2 and 0.8 ohm-cm. Comparing FIGS. 6*a* and 6*b* with the prior art semiconducting device of FIG. 1, the active devices 30 and 31 can be advantageously manufactured without having the extra step of depositing (and subsequent processing) an epitaxial layer (layer 4 in FIG. 1) on the p-type substrate 62. Normally, an epitaxial layer 4 having a resistivity of from about 0.2 to 0.8 ohm-cm is applied over the low resistivity substrate 2 of 0.01 to 0.02 ohm-cm. However, according to the present invention, an overlying epitaxial layer, such a layer 4 is not required. Accordingly, the active devices 30 and 31 can be manufactured less expensively and more efficiently since fewer manufacturing steps and less material are required to construct the ink ejector chip 18.

As shown in FIG. 6*a*, the PMOS transistor 36 includes a polysilicon gate 66 disposed adjacent to an N-well 68. P-type implants 70 are disposed adjacent the gate 66 and N-well 68. An n-type implant guard ring 32 substantially surrounds the PMOS transistor 36 and tends to prevent latch-up. The metal layer 72 provides an electrical pathway between the guard ring 32 and the voltage source Vs (FIG. 4). The metal layer 72 also contacts the p-type implants 70 of the transistor 36 providing electrical pathways to/from the transistor 36.

The NMOS transistor 38 also includes one or more dielectric layers 64 disposed adjacent to the substrate 62, as described above for the PMOS transistor 36. Furthermore, there is not an interleaving epitaxial layer disposed between the one or more dielectric layers 64 and the substrate 62. The NMOS transistor 38 includes a polysilicon gate 74 disposed adjacent to the substrate 62. N-type implants 76 are disposed adjacent the gate 74. A p-type guard ring 33 substantially surrounds the NMOS transistor 38. The metal layer 72 provides an electrical pathway between the guard ring 42 and ground (gnd) (FIG. 4). The metal layer 72 also contacts the n-type implants 76 providing electrical pathways to/from the transistor 38. It will be appreciated that the structure described in reference to FIGS. 6*a* and 6*b* can include greater or fewer layers and materials and the invention is not intended to be limited by any specific examples and/or embodiments described herein.

With continuing reference to FIG. 6*a*, the PMOS transistor 36 includes one or more dielectric layers 64 disposed adjacent to the substrate 62. As described above, there is no interleaving epitaxial layer disposed between the one or more dielectric layers 64 and the substrate 62. For example, the one or more dielectric layers 64 may include, a first dielectric field oxide (FOX), followed by phosphorus boron silicon glass (BPSG) or phosphorus silicon glass (PSG), herein referred to as first dielectric layer 61. Preferably, the total combined thickness of the first dielectric layer 61 is between about 1 um to about 2 um.

The first metal 72 consists of a heater material of tantalum aluminum (TaAl), tantalum (Ta), tantalum nitride (TaN), tantalum aluminum nitride (TaAlN), or a combination of these films. Preferably, the first metal 72 has a thickness of about 0.01 um. The first metal 72 preferably includes a metal conductor of AlCu, preferably having a thickness of about 0.5 um. The one or more dielectric layers 64 can include a second dielectric layer 63 (after the first metal). For example, the second dielectric layer 63 can be silicon nitride (SiN) and silicon carbide (SiC), a diamond-like carbon (DLC), Silox, spin on glass (SOG), or a combination of any of these films. Preferably, the second dielectric layer has a thickness of between about 0.4 um to about 0.8 um. A second metal layer (not shown) of AlCu preferably has a thickness of about 1.1 um.

Figure 7:
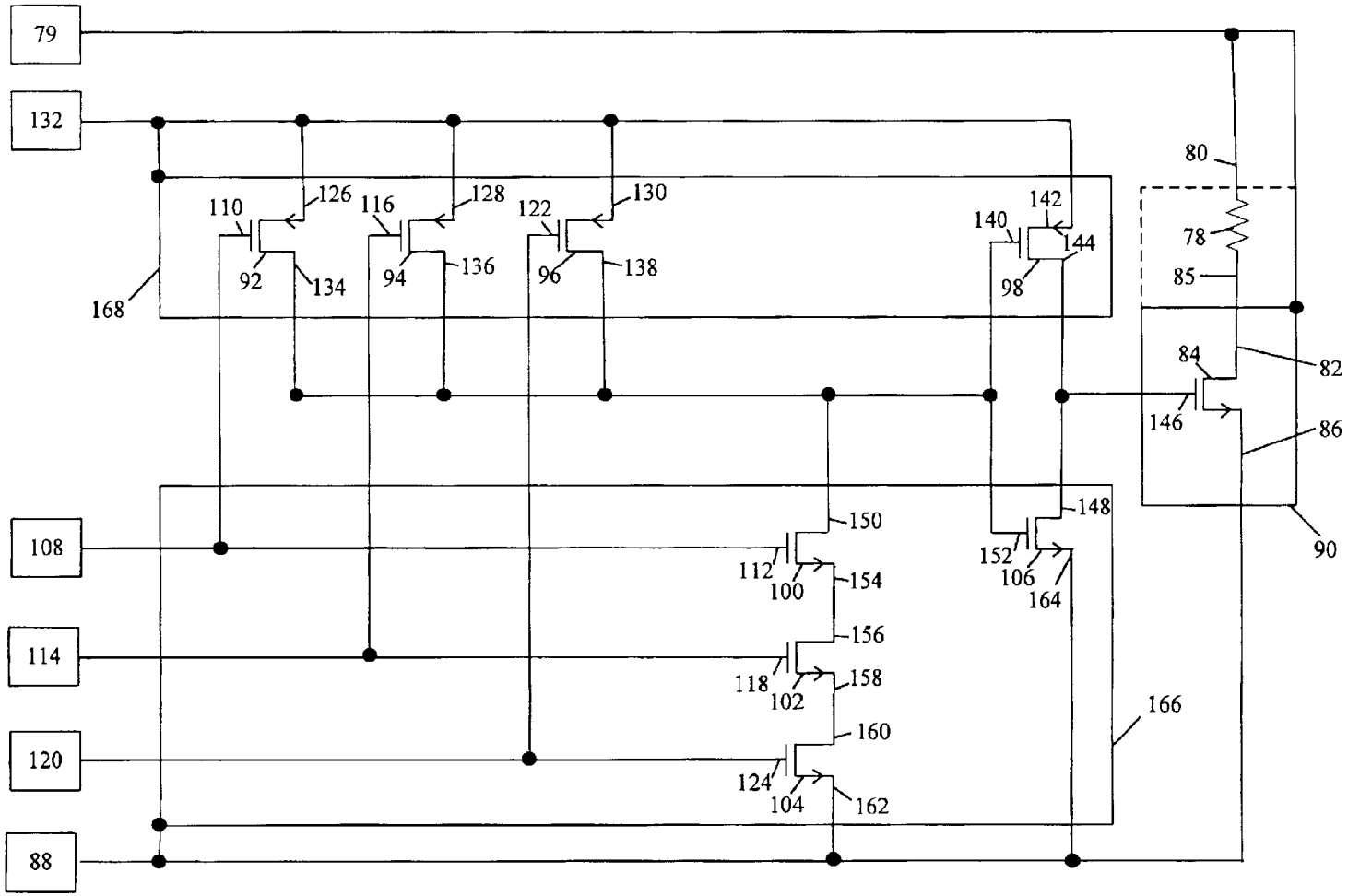

Referring now to FIG. 7, an example of a portion of an ink ejector chip 18 is shown. As described above, the ink ejector chip 18 includes a number of resistive heating elements and associated circuitry for heating ink which is ejected through one or more nozzles 22. (One heater element 78 being shown in FIG. 7). Continuing with the example of FIG. 7, a heater power lead 79 electrically connects to the high side 80 of the heater 78. The drain 82 of a power field-effect transistor (FET) 84, preferably an NMOS power FET, electrically connects to the low side 85 of the heater 78. The source 86 of the power FET 84 is electrically connected to a ground line 88.

As described below, when enabled, the power FET 84 operates to switch large amounts of current to the heater 78. Preferably, the power FET 84 operates to switch between about 100 milliamps to about 400 milliamps of current. The power FET 84 preferably includes an active area of about 50 microns by about 200 microns to about 50 microns by about 400 microns. As shown in FIG. 7, since the power FET 84 operates to switch large amounts of current, an n-type guard ring 90 is fabricated to substantially surround the power FET 84.

The n-type guard ring 90 tends to collect electrons migrating from the NMOS power FET 84 caused by the large switching current which can adversely affect the logic circuitry (logic FETs 92–106) and other components of the ink ejector chip 18. That is, guard ring 90 isolates the power FET 84 from the logic FETs 92–106. As shown in FIG. 7, the guard ring 90 can also be fabricated (shown by the dotted line) to surround the heater 78. It will be understood that the ink ejector chip 18 can include a number of heaters, logic, and power transistors which control ink ejection and the invention should not be limited by any specific examples or embodiments described herein.

As shown in FIG. 7, the logic FETs 92–106 are selectively arranged to control and activate the heater 78. Control line 108 is electrically connected to the gate 110 of PMOS transistor 92 and the gate 112 of NMOS transistor 100. Control line 114 is electrically connected to the gate 116 of PMOS transistor 94 and the gate 118 of NMOS transistor 102. Control line 120 is electrically connected to the gate 122 of PMOS transistor 96 and the gate 124 of NMOS transistor 104. Control signals in select combinations are transmitted over the control lines 108, 114, and 120 along with power signals to thereby control and activate the heater 78.

Each source 126, 128, and 130 of PMOS transistors 92, 94, and 96, respectively, is electrically connected to a logic power lead 132. Each drain 134, 136, and 138 of PMOS transistors 92, 94, and 96, respectively, is electrically connected to a gate 140 of PMOS transistor 98 and a gate 152 of NMOS transistor 106. The source 142 of PMOS transistor 98 is electrically connected to the logic power lead 132. The drain 144 of PMOS transistor 98 is electrically connected to the gate 146 of the power FET 84 and to the drain 148 of NMOS transistor 106. An n-type guard ring 168 preferably substantially surrounds the PMOS transistors 92–98. The n-type guard ring 168 tends to prevent device latch-up of the ink ejector chip 18.

The drain 150 of NMOS transistor 100 is electrically connected to the drains 134, 136, and 138 of PMOS transistors 92, 94, and 96, respectively, to the gate 140 of PMOS transistor 98, and to the gate 152 of NMOS transistor 106. The source 154 of NMOS transistor 100 is electrically connected to the drain 156 of NMOS transistor 102. The source 158 of NMOS transistor 102 is electrically connected to the drain 160 of NMOS transistor 104. The sources 162, 164 of NMOS transistors 104, 106 are electrically connected to ground 88. A p-type guard ring 166 preferably substantially surrounds the NMOS transistors 100–106. The p-type guard ring 166 tends to prevent device latch-up of the ink ejector chip 18.

During operation, the heater chip 18 switches on/off large currents very quickly. This switching of large currents tends to cause large rates of change of current with respect to time (di/dt). Thus, since the heater chip 18 incorporates a substrate devoid of an overlying epitaxial layer, at least one guard ring is included to substantially surround at least one active device which tends to protect internal circuits from latch-up conditions.

Thus, as described above, an ink ejector chip 18 is disclosed wherein one or more active devices 30 and 31 on the chip 18 are substantially surrounded by n-type or p-type guard rings 32 and 33. The guard rings 32 and 33 surrounding the active devices 30 and 31 tend to prevent latch-up of the active devices on the chip 18 during printing operations with the inkjet printer 10. Furthermore, the chip 18 is preferably devoid of an interleaving epitaxial layer between the underlying substrate 62 and one or more dielectric layers 64 on the chip 18. Accordingly, the inkjet ejector chip 18 may be manufactured efficiently and economically, while effectively tending to prevent device latch-up.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An improved ink ejector chip for an inkjet printhead, the ejector chip including a plurality of ejection devices for causing ink to be expelled from nozzles on the printhead toward a print medium, and circuitry on the chip connected to the ejection devices for controlling the activation of one or more of the ejection devices, the improvement comprising:

at least one active device having power and ground connections, the active device including:

a substrate having a resistivity and being devoid of an overlaying epitaxial layer, at least one dielectric layer disposed on the substrate, and at least one metallic layer disposed adjacent to the at least one dielectric layer and the substrate, a guard ring disposed on the substrate substantially surrounding the active device, wherein the guard ring tends to substantially prevent latch-up of the active device during operation of the ejection devices on the chip, a power lead electrically connected to the active device for providing power to the active device, and a ground lead electrically connected to the active device.

2. The ink ejector chip of claim 1 wherein the guard ring further comprises a p-type implant disposed on the substrate and the active device comprises a n-type metal-oxide semiconductor (NMOS) transistor.

3. The ink ejector chip of claim 2 wherein the guard ring is electrically connected to the ground lead.

4. The ink ejector chip of claim 3 wherein the n-type metal-oxide semiconductor (NMOS) transistor includes a gate, a source, and a drain, wherein the gate of the NMOS transistor is electrically connected to a common electrical input, the drain is electrically connected to a drain of one or more adjacent active devices, and the source is electrically connected to ground.

5. The ink ejector chip of claim 4 wherein further comprising a power field effect transistor (FET) having a gate, a source, and a drain, wherein the FET gate is electrically connected to the drain of the NMOS transistor, the FET drain is electrically connected to a heater element, and the FET source is electrically connected to ground, and a guard ring substantially surrounding the power FET which tends to collect electrons migrating from the power FET.

6. The ink ejector chip of claim 1 wherein the guard ring further comprises an n-type implant disposed on the substrate and the active device comprises a p-type metal-oxide semiconductor (PMOS) transistor.

7. The ink ejector chip of claim 6 wherein the guard ring is electrically connected to the power lead.

8. The ink ejector chip of claim 6 wherein the p-type metal-oxide semiconductor (PMOS) transistor includes a gate, a source, and a drain, wherein the gate of the PMOS transistor is electrically connected to a common electrical input, the drain is electrically connected to a drain of one or more adjacent active devices, and the source is electrically connected to the power lead.

9. The ink ejector chip of claim 8 wherein further comprising a power field effect transistor (FET) having a gate, a source, and a drain, wherein the FET gate is electrically connected to the drain of the PMOS transistor, the FET drain is electrically connected to a heater element, and the FET source is electrically connected to ground, and a guard ring substantially surrounding the power FET which tends to collect electrons migrating from the power FET.

10. The ink ejector chip of claim 1 wherein the active device further comprises a power field-effect transistor (FET) electrically connected to a heater and the guard ring is an n-type implant.

11. The ink ejector chip of claim 1 wherein the one or more dielectric layers include a first dielectric layer of a field oxide (FOX) and phosphorus boron silicon glass (BPSG) or phosphorus silicon glass (PSG), and a second dielectric layer of silicon nitride (SiN) and silicon carbide (SiC) film, a diamond-like carbon (DLC) film, Silox film, spin on glass (SOG), or a combination thereof.

12. The ink ejector chip of claim 11 wherein the active device further comprises a power field-effect transistor (FET) electrically connected to a heater and the guard ring is an n-type implant.

13. In a printhead for an inkjet printer for printing an image on a print medium, the printhead including:

a housing for containing ink and including a nozzle plate, an improved ink ejector chip located adjacent to the nozzle plate on the housing, the improvement comprising:

at least one active device having power and ground connections, the active device including:

a substrate having a resistivity and being devoid of an overlying epitaxial layer, at least one dielectric layer disposed on the substrate, and at least one metallic layer disposed adjacent to the at least one dielectric layer and the substrate, a guard ring disposed on the substrate and substantially surrounding the active device, wherein the guard ring substantially prevents latch-up of the active device during operation of the ink ejector chip, a power lead electrically connected to an active device for providing power to the active device, and a ground lead electrically connected to the active device.

14. The printhead of claim 13 wherein the guard ring further comprises a p-type implant disposed on the substrate and the active device comprises a n-type metal-oxide semiconductor (NMOS) transistor.

15. The printhead of claim 14 wherein the guard ring is electrically connected to the power lead.

16. The printhead of claim 13 wherein the guard ring further comprises a n-type implant disposed on the substrate and the active device comprises a p-type metal-oxide semiconductor (PMOS) transistor.

17. The printhead of claim 16 wherein the guard ring is electrically connected to ground.

18. In an inkjet printer for printing an image on to a print medium, the printer including:

a printhead for printing ink through a nozzle plate disposed on the printhead, an improved ink ejector chip on the printhead, the improvement comprising:

at least one active device having power and ground connections, the active device including:

a substrate having a resistivity and being devoid of an overlaying epitaxial layer, at least one dielectric layer disposed on the substrate, and at least one metallic layer disposed adjacent to the at least one dielectric layer and the substrate, a guard ring disposed on the substrate and substantially surrounding the active device, wherein the guard ring substantially prevents latch-up of the active device during operation of the ink ejector chip, a power lead for providing power to the active device, and a ground lead electrically connected to the active device.

19. The inkjet printer of claim 18 wherein the active device further comprises a p-type metal-oxide semiconductor (PMOS) transistor having a gate, a source, and a drain, and the guard ring is a n-type implant disposed on the substrate.

20. The inkjet printer of claim 18 wherein the active device further comprises a n-type metal-oxide semiconductor (NMOS) transistor having a gate, a source, and a drain, and the guard ring is a p-type implant disposed on the substrate.

* * * * *